United States Patent [19]

Kishikawa et al.

[11] 3,997,739

[45] Dec. 14, 1976

[54] ELECTRODYNAMIC TYPE ELECTROACOUSTIC TRANSDUCER

[75] Inventors: Kenichiro Kishikawa, Musashino; Atsushi Adachi, Akishima, both of Japan

[73] Assignee: Foster Electric Co., Ltd., Japan

[22] Filed: Jan. 2, 1975

[21] Appl. No.: 537,952

[52] U.S. Cl. ..... 179/115.5 PV; 179/180; 181/166

[51] Int. Cl.[2] ..... H04R 9/02

[58] Field of Search ..... 179/115.5 PV, 180, 181 R, 179/111 R; 181/166, 169

[56] References Cited

UNITED STATES PATENTS

| | | | |
|---|---|---|---|
| 1,604,788 | 10/1926 | Rocind | 181/166 |
| 1,815,564 | 7/1931 | High | 179/115.5 R |
| 1,868,640 | 7/1932 | Dodszus | 181/166 |
| 2,934,612 | 4/1960 | Stanton | 179/111 R |
| 3,674,946 | 7/1972 | Winey | 179/115.5 PV |

FOREIGN PATENTS OR APPLICATIONS

| | | | |
|---|---|---|---|
| 239,344 | 8/1964 | Austria | 179/115.5 PV |
| 1,465,965 | 1/1967 | France | 179/111 R |
| 431,758 | 4/1934 | United Kingdom | 179/111 R |

*Primary Examiner*—George G. Stellar
*Attorney, Agent, or Firm*—Leydig, Voit, Osann, Mayer & Holt, Ltd.

[57] ABSTRACT

An electrodynamic type electroacoustic transducer wherein a diaphragm of a nonmagnetic and insulative material having thereon a series of conductors is disposed between a pair of magnetic circuits opposing one another through a slight clearance so that the conductors will lie in magnetic flux flowing between opposite polarity ends of at least a pair of permanent magnets in each magnetic circuit and will move in directions transverse the flux when the diaphragm is vibrated, in which the diaphragm is resiliently held in said clearance by means of an elastic support means inserted at least between the diaphragm and the respective opposing pole ends of the magnets in both circuits so as to be prevented from contacting the pole ends when vibrated. Preferably said means on sound-passing side of the magnetic circuit is a disk-shaped pad of glass fiber or the like and the one on non-sound-passing side circuit is glass fiber or the like filled in spaces defined by the diaphragm and the magnets and soft iron plate coupling them in the circuit so as to absorb sounds.

1 Claim, 5 Drawing Figures

ELECTRODYNAMIC TYPE ELECTROACOUSTIC TRANSDUCER

The invention relates to electroacoustic transducers and, more particularly, to an electrodynamic type electroacoustic transducer comprising a diaphragm made of a nonmagnetic and insulative material and having a series of conductors formed thereon and a plurality of permanent magnets respectively arranged as opposed to each other through a slight clearance on both surfaces of the diaphragm so as to enclose the same in the magnetic flux.

A conventional electroacoustic transducer of this kind has such structure typically as is shown in FIGS. 1 and 2, in which 1 is a diaphragm made of a membrane of a nonmagnetic material, 2, 2', 2'' . . . and 3, 3', 3'' . . . are a plurality pair of elongated permanent magnets, each of the respective pairs 2 and 3, 2' and 3', 2'' and 3'' . . . of which is arranged as opposed to each other with magnetic pole surfaces through a slight clearance on both sides of the diaphragm 1 and in parallel relation to adjacent pairs so that, while the magnetic poles of the respective pairs adjacent one another in expanding direction of the diaphragm 1 will be alternately of different polarities, the poles of each pair opposing will be of the same polarity. 4, 4' . . . are parallel strip conductors formed on the diaphragm 1 by such a means as a printing or the like so as to be respectively positioned intermediate between the adjacent magnets 2 and 2', 2' and 2'' . . . or 3 and 3', 3' and 3'' . . . , which conductors are connected at the respective ends with one another so as to be at least one zigzag shaped continuous conductor, as shown in FIG. 2. 5 and 6 are soft iron plates bonded respectively on outside surfaces of the respective groups of the magnets 2, 2', 2'' . . . and 3, 3', 3'' . . . on each side of the diaphragm 1 and one of them, for example, the iron plate 5, is provided with perforations 7 for allowing sounds to pass therethrough, between the adjacent magnets 2 and 2', 2' and 2'' and so on. Dotted lines shown in FIG. 1 in spaces between the opposing and adjacent magnetic pole surfaces represent magnetic flux distribution.

The operation of the electroacoustic transducer shown in FIGS. 1 and 2 shall be explained next.

Referring to FIG. 1, the opposing surfaces of, for example, the pair of magnets 2' and 3' are of north polarity and those of adjacent pairs of the magnets 2 and 3, 2'' and 3'' are of south polarity, so that the magnetic flux will be caused to flow from the respective opposing N-pole to the respective adjacent S-poles so as to be substantially in parallel with the plane of the diaphragm 1. The parallel sections 4, 4' . . . of the continuous conductor are disposed thus in such magnetic flux at right angles with respect to the flowing direction of the flux.

In case an electric current is passed through the continuous conductor in the above arrangement, the diaphragm 1 on which the conductor is provided is subjected to an electromagnetic force effective in a direction perpendicular to the plane of the diaphragm. While the direction of the electric current flowing each of the parallel sections 4, 4' . . . of the conductor is opposite to one another, the direction of the magnetic flux traversing each of such sections 4, 4' . . . is also opposite to one another. Consequently, the diaphragm 1 is subjected to a driving force effective in a fixed direction, so that the electroacoustic transducer will be utilized as a speaker operated in response to the direction and magnitude of the current passed through the strip conductor.

It is obvious that in case the diaphragm 1 is caused to be vibrated by a sound contrarily to the above, there is produced an electromotive force in the conductor on the diaphragm 1 vibrated, so that the electroacoustic transducer will be able to be utilized as a microphone.

In the electroacoustic transducer of this formation, the nearer of the opposed permanent magnets 2 and 3, 2' and 3' . . . approach each other, the more the magnetic fluxes will converge and the magnetic induction will improve but, on the other hand, the diaphragm will be apt to contact the magnetic pole surfaces of the magnets when vibrated so as to cause a buzzing or the like undesirable phenomenon.

The present invention has been suggested to remove such defects as above in conventional devices of the kind referred to and has successfully solved such problems by interposing an elastic support means between the magnetic pole surfaces of the permanent magnets on the sound passing front surface side provided with the perforations and the diaphragm and filling a sound absorbing material between the soft iron plate on the other back surface side and the diaphragm.

A main object of the present invention is to provide an electroacoustic transducer which is high in the efficiency and favorable in the frequency characteristic.

The present invention shall now be detailed in the following with reference to a preferred embodiment shown in accompanying drawings, in which.

Figure 1:
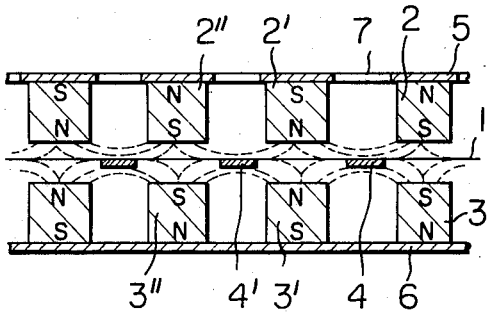
Fig. 1 PRIOR ART
FIG. 1 is a fragmentary sectioned view of a known electroacoustic transducer showing essential parts thereof.
Figure 2:
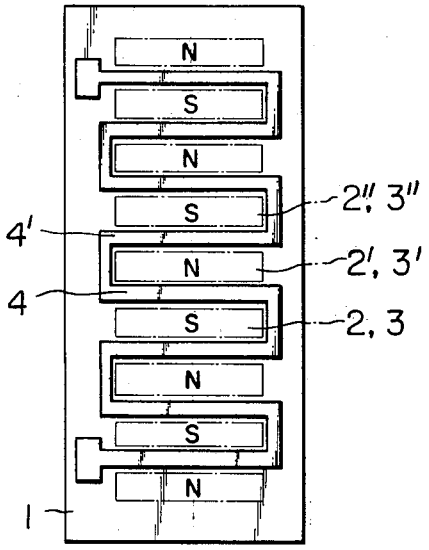
Fig. 2 PRIOR ART
FIG. 2 is a plan view of a diaphragm used in the electroacoustic transducer of FIG. 1.
Figure 3:
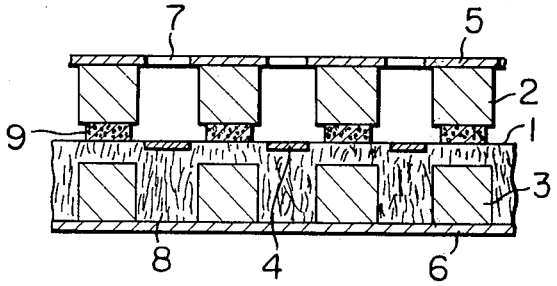
FIG. 3 is a sectioned view similar to FIG. 1 of an embodiment of the electroacoustic transducer according to the present invention.
Figure 4:
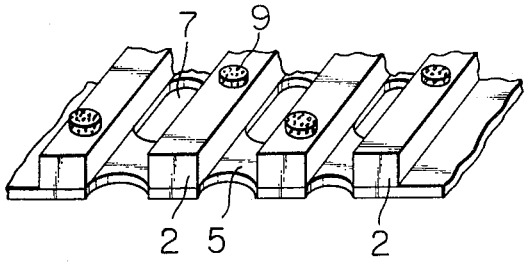
FIG. 4 is a perspective view of a part of the transducer shown in FIG. 3.

Referring first to FIGS. 3 and 4 showing an embodiment, which is most preferable, of the electroacoustic transducer according to the present invention, a plurality pair of the permanent magnets 2 and 3 is arranged as opposed respectively through a slight clearance from the diaphragm 1 and on both sides of said diaphragm 1 which is provided with the conductors 4, so that the magnetic pole surfaces of the magnets 2 or 3 adjacent one another on the same side of the diaphragm will have alternately opposite polarities and the magnetic pole surfaces of the respective opposing pairs of the magnets 2 and 3 will have the same polarities. The conductor 4 formed on the diaphragm is in a zigzag shape having parallel straight sections respectively arranged so as to be positioned intermediate between the respective opposing pairs of the magnets. The soft iron plates 5 and 6 are bonded respectively on the outside surfaces of the respectively opposing pairs of the magnets 2 and 3 and the soft iron plate 5 is provided with the perforations 7 through which sounds are to be radiated or passed. On the sound radiating or passing side of the diaphragm 1, that is, on the side facing the perforations 7, an elastic disk-shaped pads 9 made, for example, of a glass wool are pasted to the magnetic pole surfaces of the respective magnets 2 so as to be interposed between the diaphragm 1 and the magnetic pole surfaces of the permanent magnets 2. It is preferable that these pads 9 are made in a columnar shape. Further, a sound absorbing material 8 of, for example, a glass wool is placed so as to be pressed and fitted in the spaces between the diaphragm 1 and the soft iron plate 6 as well as the permanent magnets 3.

In the present invention, as described above, a plurality of elastic pads 9 are interposed between the permanent magnets 2 and the diaphragm 1 on the sound radiating or passing side of the diaphragm 1, that is, on the side having the perforations 7 in the soft iron plate 5 and the sound absorbing material 8 is placed between the diaphragm 1 and the soft iron plate 6 on the other side of the diaphragm 1, that is, on the side of the soft iron plate 6 having no perforation so that, even if the diaphragm is vibrated in a very slight clearance between the respective opposing magnets, the diaphragm and permanent magnet surface will be able to be prevented from coming into contact with each other and, therefore, the diaphragm will be able to be prevented from causing any buzzing or the like. Further, as the diaphragm thus does not contact the magnetic pole surfaces, the clearance between the opposing magnets can be made so small that the efficiency of the electroacoustic transducer can be remarkably elevated.

As is well known, vibrated diaphragms, such as the diaphragm 1 in the drawings, tend to develop standing, or constant, waves which affect the fidelity of reproduction.

The reproduction characteristic of the present transducer can be improved further by locating the pads 9 in respective positions to coincide with the regions of vibration of the standing wave so as to mechanically brake the standing wave vibration.

Figure 5:
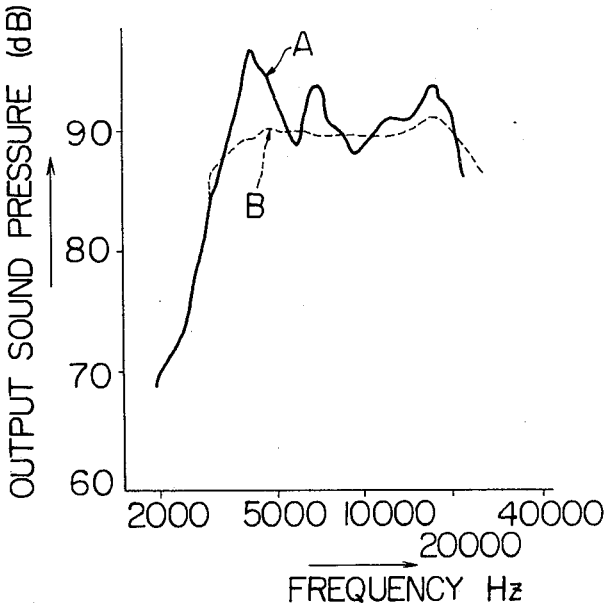
FIG. 5 is a diaphragm showing output sound pressure-to-frequency characteristics of the electroacoustic transducer of the structure shown in FIG. 3.

Referring to FIG. 5 showing the frequency characteristics, the curve A of solid line is of a known transducer and the curve B of dotted line is of a product according to the present invention. Comparing the both frequency characteristic curves, it is readily seen that the electroacoustic transducer according to the present invention is remarkably improved in such characteristic in the overall range of the frequency.

In the foregoing descriptions, the material of the elastic pads 9 is not limited to the glass wool as disclosed but may be of any of a foamed rubber elastomer, felt or the like. In this connection, it may be possible to achieve the purpose of preventing the diaphragm vibrated from contacting the opposing pole surfaces of the permanent magnets, by providing the same type of pads as those pads 9 disclosed at opposing positions to the pads 9 so as to be disposed between the diaphragm 1 and the respective magnets 3 instead of the sound absorbing material 8, so that the diaphragm 1 will be held in position between such opposing pads. While this aspect of the present invention thus achieves effectively the contact preventing purpose of the diaphragm with the magnetic pole surfaces opposing a least clearance, the embodiment as disclosed and shown in FIG. 3 where the sound absorbing material 8 is filled in the space defined by the diaphragm 1, soft iron plate 6 having no perforations and permanent magnets 3 coupled by the plate 6, is further effective in achieving higher sound transducing or reproducing effect and is thus disclosed as the most preferable embodiment of the present invention.

It should be also noticed that the present invention can be applied extensively to speakers, headphones, microphones and the like electroacoustic transducers with the same effects.

What is claimed is:

1. An electrodynamic type electroacoustic transducer comprising a first series of permanent bar magnets arranged in a plane spaced parallel to one another and having presented surfaces and back surfaces and with the magnets polarized so that the presented surfaces provide poles of alternating polarity, a second similar series of permanent bar magnets arranged in a plane having presented surfaces and back surfaces, the presented surfaces being in closely spaced opposition to the presented surfaces of the magnets in the first series to define a uniform planar clearance space between them, the opposed surfaces being of the same polarity so that lines of flux are set up in the plane of the clearance space between adjacent magnets in the same series, a planar diaphragm of non-magnetic insulative material centered in the clearance space, the diaphragm having on its surface a series of conductors alined with the spaces between adjacent magnets, a pair of terminals, the conductors being so connected to one another and to the terminals that an alternating voltage applied across the terminals produces simultaneous movement of all of the conductors and hence the diaphragm toward and away from the presented surfaces of the magnets, soft iron plates secured to the back surfaces of the respective series of magnets, at least one of the plates being perforated for allowing sounds to pass therethrough, the spaces between adjacent magnets in one series being filled with loosely packed resilient fibrous material, and means including elastic pads of resilient material interposed in a two-dimensional pattern between the diaphragm and at least certain ones of the presented surfaces of the magnets in the other series, the fibrous material and the elastic pads serving to damp the diaphragm as well as to limit its excursion.

* * * * *